United States Patent [19]

Backer

[11] Patent Number: 4,478,037

[45] Date of Patent: Oct. 23, 1984

[54] TWISTING METHOD AND APPARATUS

[76] Inventor: Stanley Backer, 5 Irving Rd., Waban, Mass. 02168

[21] Appl. No.: 399,127

[22] Filed: Jul. 16, 1982

[51] Int. Cl.[3] ..... D02G 1/04; D01H 7/92

[52] U.S. Cl. ..... 57/284; 57/334

[58] Field of Search ..... 57/284, 287, 288, 332, 57/334

[56] References Cited

U.S. PATENT DOCUMENTS

| | | | |
|---|---|---|---|
| 2,751,747 | 6/1956 | Burleson . | |
| 2,862,525 | 12/1958 | McGinley . | |
| 2,948,133 | 8/1960 | Schwartz | 57/284 X |
| 3,009,312 | 11/1961 | Seem et al. . | |
| 3,069,837 | 12/1962 | Olson | 57/287 |
| 3,099,907 | 8/1963 | Masurel et al. . | |
| 3,225,533 | 12/1965 | Henshaw . | |
| 3,296,786 | 1/1967 | Wyatt . | |
| 3,298,342 | 1/1967 | Smiley et al. . | |
| 3,327,461 | 6/1967 | Wyatt | 57/284 |
| 3,330,104 | 7/1967 | Dunwoody, Jr. . | |
| 3,434,275 | 3/1969 | Backer et al. . | |
| 3,495,390 | 2/1970 | Cummings et al. | 57/284 |
| 3,559,391 | 2/1971 | Rice | 57/334 X |
| 3,680,302 | 8/1972 | Hess et al. | 57/334 X |
| 3,816,993 | 6/1974 | McWaters . | |
| 3,861,129 | 1/1975 | Doschko . | |
| 3,894,337 | 7/1975 | Boisvert . | |

FOREIGN PATENT DOCUMENTS 890053 2/1962 United Kingdom .

OTHER PUBLICATIONS

"Journal of the Textile Institute", Jun. 1970, vol. 61, No. 6, pp. 245-259.

*Primary Examiner*—Donald Watkins

*Attorney, Agent, or Firm*—Cushman, Darby & Cushman

[57] ABSTRACT

A twisting method for a yarn strand includes passing the yarn to a pin where the yarn is wrapped no more than 360° about the pin and where the pin intersects the yarn path at an angle of approximately between 90° and 100°, the yarn may be previously heated and cooled upstream of the twister to impart texture to a thermoplastic yarn; the pin twister may be flexible and may be vibrated to induce random variations in the amount of twist imparted to the yarn wrapped around the pin; the yarn downstream of the false twisted pin may be passed directly to a fabric forming machine for incorporation of the yarn into a fabric; the pin may be used to impart twist to a moving yarn in a variety of applications.

24 Claims, 7 Drawing Figures

TWISTING METHOD AND APPARATUS

BACKGROUND AND BRIEF DESCRIPTION OF THE INVENTION

The present invention relates the art of yarn twisting, and more particularly, to the false twisting of yarns or strands as an integral component of a complete yarn process such as false twist texturing of thermoplastic yarns.

In the past, in this field, manufacturers of texturing equipment have devised a large number of different types of devices for imparting twist to a moving thermoplastic filament which is temporary in nature in that as the yarn passes the false twisting device, the twist disappears thus giving rise to the designation of the yarn as having been false twisted. With thermoplastic filaments, where the yarn is heated while in the twisted state and then cooled prior to untwisting, bulk and stretch characteristics are imparted to the yarn since the thermoplastic yarns tend to return to their twisted state when relaxed.

In attempting to increase the production capacity of false twisting machines, attention has been, to a large measure, directed to improvement of the false twisting device itself. These endeavors have resulted in the use of rotating tubes having pins therein about which the yarn is wrapped so that when the tube is rotated at high speeds, twist is imparted to the moving yarn strand. In other developments, friction discs have been employed where the yarn is pulled over the periphery of one or more discs which impart twist to the yarn by virtue of the frictional contact of the rotating discs with the moving yarn. See, in this regard, U.S. Pat. Nos. 3,232,037, 3,668,856 and 3,861,129, as well as the references cited in these patents for representative examples of prior false twisting devices.

One of the primary disadvantages of the devices of the prior art, such as those mentioned above, is the maintenance and power consumption required to operate the devices. Further, once the devices are set up for a particular yarn, it is often impractical to impart any variations to the twist level imposed on the yarn without undue complications or great loss in operating time.

Attempts have been made by workers in this field to simplify the false twisting device and it has been determined that a satisfactory twisting operation can be effected by wrapping a multi-filament yarn about a pin and then moving the yarn with suitable tension past the pin. The frictional engagement of the moving yarn with the pin surface induces twist buildup upstream of the pin. See, in this regard, the Olson U.S. Pat. No. 3,069,837.

In the Olson device, it is recommended that the pin or wire disclosed make an angle of between 30° to about 60° to the yarn path with the wire or pin being slanted in the direction of the yarn travel in order to obtain non-alternating twist in the yarn.

In the Wyatt U.S. Pat. No. 3,327,461, there is disclosed an apparatus for imparting twist to a moving yarn where the yarn is passed over either a freely or driven rotating frictional surface at particular helix angles.

The present invention provides an improvement in the pin type of false twisting devices and, in part, is based on the discovery that where the pin is set within a specific angular range relative to the yarn path, the amount of twist that can be imposed on the moving yarn is greatly increased without interfering with the throughput velocity of the yarn. Further, the present invention contemplates the substitution of a pin twisting device for each yarn in a false twisting machine and a mechanism for varying the angle of intersection between the false twisting pin and the individual yarn paths whereby variations in the amount of twist imposed on the individual yarn strands can be obtained to result in an interesting effect in a resulting fabric. One such means incorporates a vibrating device for continually or randomly vibrating the pin about an axis perpendicular to the longitudinal axis of the pin to correspondingly vary the amount of twist imposed on an individual yarn strand and to allow real twist to pass the pin during such transient operation. Conversely, the present invention provides an arrangement where a common pin means is set at a predetermined angle and a plurality of individual yarn strands are wrapped around the pin means at spaced intervals so that the angle of intersection between the individual yarn paths and the pin means is substantially the same which will result in substantially uniform imposition of twist on the individual yarns.

A particular application of the present invention, which is the subject of a separate, co-pending application, involves the utilization of the pin twisting means where variations in the amount of twist imposed on the yarn are employed and the yarn is then fed immediately to a fabric forming machine such as a knitting machine or a loom for incorporation into the fabric. A wide variety of interesting fabric effects can be achieved by varying the twist inserted either randomly or according to a set pattern and considerable production costs can be saved by immediately incorporating the thus twisted yarn into a fabric.

The foregoing and other advantages will become apparent as consideration is given to the following detailed description taken in conjunction with the accompanying drawings, in which:

DETAILED DESCRIPTION OF THE INVENTION

Figure 1:
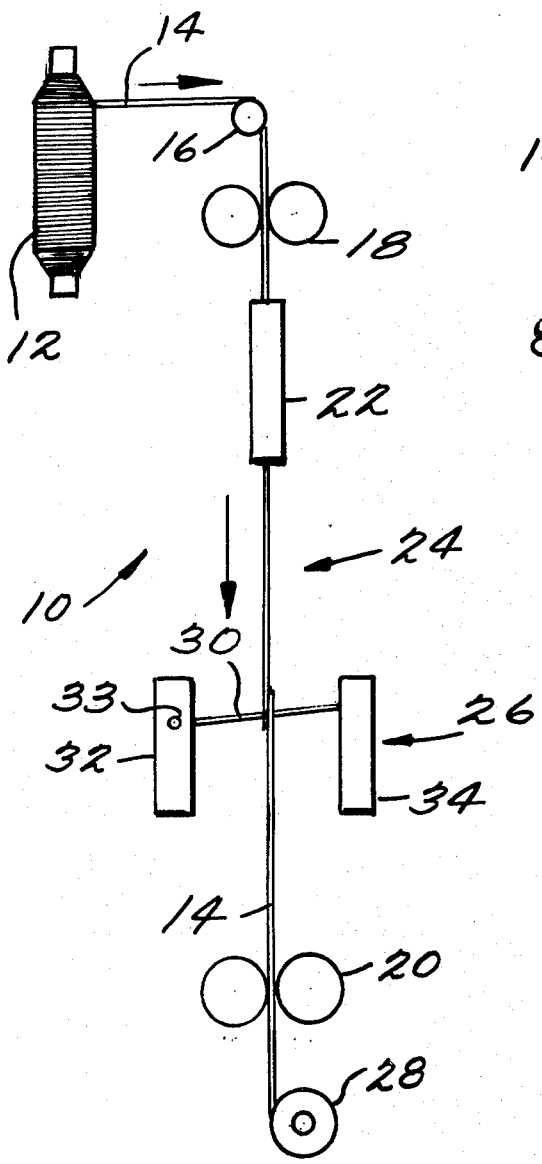
FIG. 1 is a schematic view of one embodiment of the present invention.

Referring now to the drawings wherein like numerals designate corresponding parts throughout the several views, there is shown schematically in FIG. 1 an apparatus generally designated at 10 for false twisting thermoplastic filament yarn and which includes a supply spool from which yarn 14 is pulled over a guide member 16 through a pair of feed rolls 18. At the other end of the apparatus 10 another pair of feed rolls 20 are rotated in cooperation with the feed rolls 18 to move the yarn 14 under controlled tension through a heating zone wherein a yarn heater 22 is located, through a cooling zone 24 and then through a false twisting device generally designated at 26. Downstream of the feed rolls 20, the yarn may be wound up on the take-up package 28 or passed to other yarn treating or textile equipment.

Figure 2:
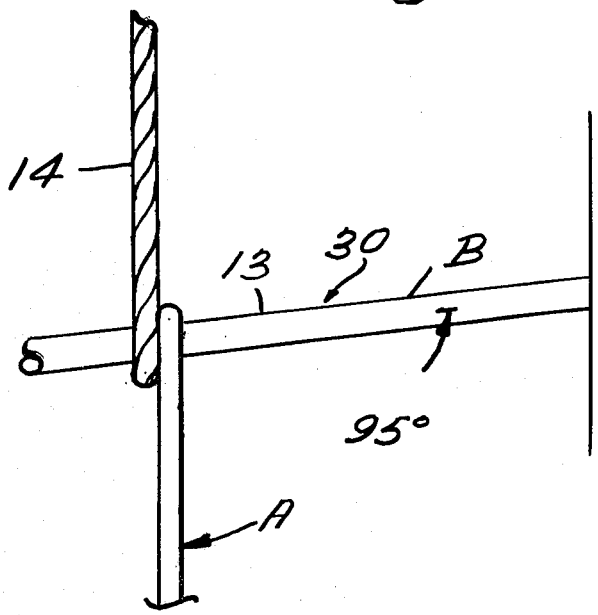
FIG. 2 is a greatly enlarged view of the pin and yarn of FIG. 1.

According to the present invention, the false twisting means 26 comprises a smooth cylindrical pin 30 about which the yarn 14 is wrapped no more than 360° in the "Z" direction as shown in the configuration of FIG. 2. Angles of wrap exceeding 360° lead to excessive threadline tensions downstream of the pin while at angles of wrap below 90°, the twist level in the threadline upstream of the pin is significantly reduced. One end of the pin 30 may be mounted in any suitable manner in a support member 32 so as to be pivotable about axis 33 while the other end is mounted in a support member 34, the details of which will be described in more detail hereinafter.

Turning now to FIG. 2, there is shown an enlarged view of the intersection of the yarn 14 with the pin 30. According to the present invention, the longitudinal axis of the pin 30 intersects the yarn path at an angle preferably set between 90° and 100°, which angle is measured between the longitudinal axis of the pin 30 on the side 13 last contacted by the departing yarn and the downstream path of the yarn 14 as indicated in FIG. 2. It has been found that, according to one mode of operation where the angle of the pin is significantly less than 90°, twisting of the yarn occurs when the axially moving yarn is made to follow the geometrically torsional path around the surface of the pin 30 with the twist disappearing downstream of the pin 30 also as shown in FIG. 2. Another mode of twisting has been discovered in this arrangement where the yarn exiting from the contact path of the pin tangentially contacts the entering segment of the yarn at an angle to its local axis. In this arrangement, with the angle A within the range of 90°-100°, the tangential contact greatly increases the amount of twist, or turns per inch imparted to the yarn 14 upstream of the pin 30. Further, it has been found that at pin tilt angles just exceeding 90°, the false twisting rate is considerably more sensitive to small angle changes than it is for tilt angle changes below 90°, for example, from 85° to 45°.

This feature of the present invention gives rise to a number of useful applications where interesting yarn effects can be easily obtained without requiring extensive modification of a false twist apparatus or any appreciable machine downtime.

Figure 3:
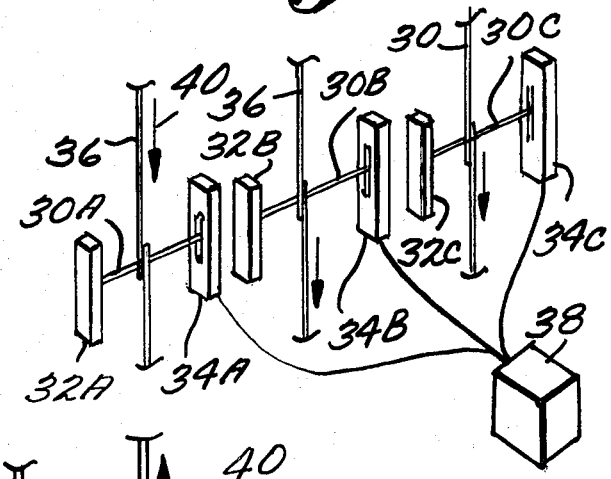
FIG. 3 is a schematic illustration of another embodiment of the present invention where a plurality of individual pin means are separately controlled in a false twisting machine.

In one embodiment, as shown in FIG. 3, each position of a false twist machine which may include up to 200 yarn twisting positions, may be modified by incorporating the twisting device of the present invention. In FIG. 3, three of such positions are schematically illustrated where separate yarn strands 36 are wrapped around individual pins 30A, 30B and 30C, each of which is positioned with its own support members 32A, 34A, 32B, 34B and 32C, and 34C for the associated pins. In this embodiment, one of the support members, such as those designated 34A-C, are provided with mechanisms such as gears which which may be rotated to vary the angle with which the respective pins 30A-C intersect the associated yarn paths by means of a control device 38. The control device 38 may be operated to vary the operation of the gears in the support members 34A-C to vary the angle of intersection of each of the pins 30A-C, either uniformly or randomly, to vary the amount of twist imparted to the respective yarns. In order to eliminate, momentarily, the yarn-on-yarn contact which causes higher false twist levels when the pin intersects the yarn in the 90°-100° range, the angle of intersection may be varied to as little as 80° which will momentarily have a significant effect on the yarn twist. In this embodiment, the yarns are illustrated as passing downwardly in the direction of arrow 40 corresponding to the arrangement shown in FIG. 1.

Figure 4:
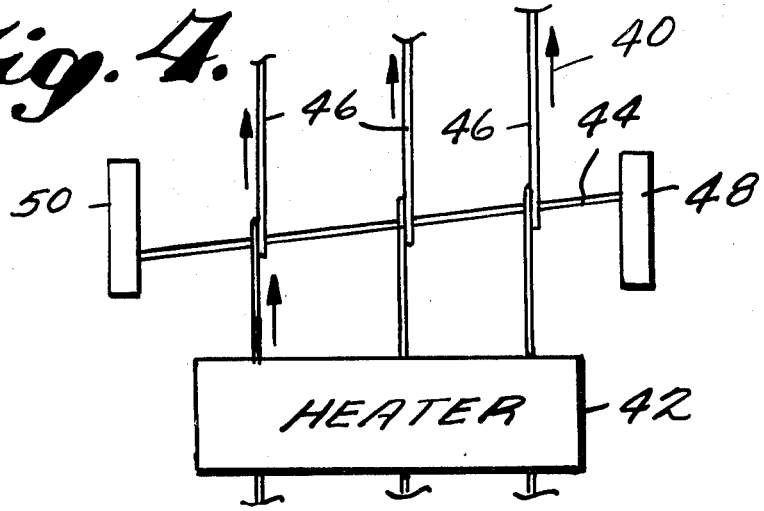
FIG. 4 illustrates a schematic view of another embodiment of the present invention where a common pin means is used for a plurality of yarn ends.

In another embodiment, such as that illustrated in FIG. 4, the yarns may be passed upwardly from the supply through a heater 42 and then to a common pin means 44 about which each of the yarns 46 is wrapped. The pin means 44 may be set at a desired angle which will be the same with respect to each of the yarn paths by appropriate manipulation of the support member control 48 while the other support member 50 simply serves as a pivot mount for the other end of the pin means 33, as in the previous embodiments.

With both the support members 48 of the FIG. 4 embodiment and the support members 34A-C of the FIG. 3 embodiment, rapidly vibratory motion may be imparted to the respective pin means to continuously vary the twist imparted to the yarns wrapped around the respective pin means which will result in interesting yarn effects. In such an arrangement, the respective support member controls may be in the form of an electromagnet mounting device where current variations to the electromagnet will impart vibration to the respective pin means.

Figure 5:
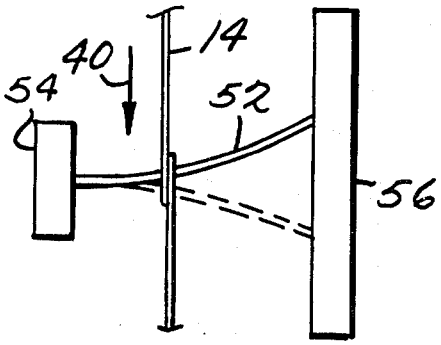
FIG. 5 is a schematic view showing a flexible pin means and mounting arrangement.

Turning now to the embodiment of FIG. 5, a greater variety of yarn effects can be achieved, it has been determined, where the pin means 52 are flexible along its longitudinal axis. In this arrangement, one end of the pin means 52 is securely mounted in one support member 54 while the other end is mounted in a support member 56 which contains a suitable mechanism for moving the other end of the pin means 52 through a limited arc to rapidly change the local angle of intersection between the pin means 52 and the yarn path 14. In this regard, suitably located electromagnets that are intermittently operated should be suitable or the previously mentioned motor driven gear mechanism should suffice.

In most textile operations, the moving yarn frequently experiences variations in tension due, for example, to contact with various guide members and the like. By making the pin sufficiently flexible, these tension variations alone will cause the pin to flex and thereby induce twist variations in a random manner or, if desired, the tension variations may be induced by selectively engaging the yarn along its path with a friction member or the like.

Figure 6:
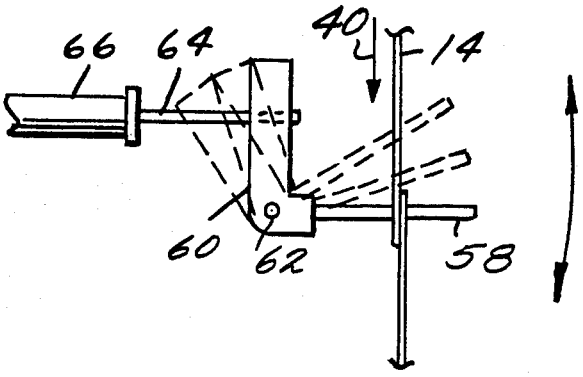
FIG. 6 shows another embodiment of the present invention where a vibrating means is employed to vary the angle of intersection of the pin means of the present invention.

In FIG. 6, the pin 58 is secured at one end to an armature 60 which is mounted for pivotal movement on a pin 62. At one end of the armature 60, a reciprocating link 64 is secured which is operated by an appropriate mechanism such as a solenoid 66 to effect pivoting of the armature 60 and, thus, of the pin 58 about which the yarn 14 is wrapped, as in the previous embodiment. This provides a very simple and durable means for altering the angle of intersection of the axis of the pin 58 and the path of the yarn 14 and can also be employed to vibrate the pin 58 about the pivot point 62 which can be effected by rapid actuation of the solenoid 46.

Figure 7:
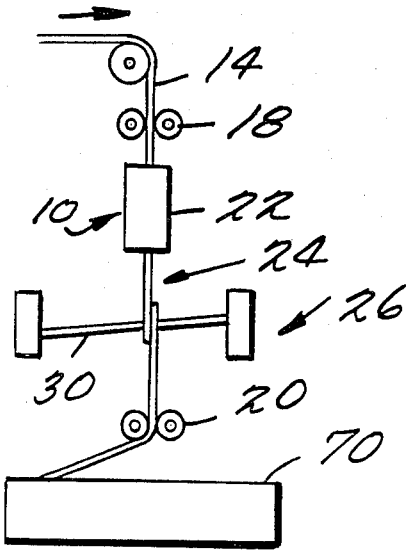
FIG. 7 is a schematic view of the arrangement of FIG. 1 shown in conjunction with the fabric forming machine.

In FIG. 7, another useful application of the principles of the present invention is disclosed where a yarn 14 is fed past feed rollers 17 through a heater 22 and cooling zone 24 and is then wrapped 360° about pin 30 as in FIG. 2. As discussed above, this arrangement will impose twist on the yarn 14 upstream of the pin 30, which twist will disappear downstream of the pin 30 where the yarn is then fed through feed rollers 20 to a fabric forming machine such as a conventional knitting machine or weaving loom schematically indicated at 70, but while the pin is in motion, some twist will pass the pin to appear in the fabric. The angle of the pin 30 can be adjusted by the device 26 as previously discussed.

As will be apparent from the foregoing, the diameter of the pin twisting means of the present invention can be selected over a wide range in correspondence to the denier of the yarn being treated. For example, for a 150 denier yarn, a pin twister having a diameter on the order of 0.02 inches should be suitable, while for carpet yarns in the range of 2,000–3,000 denier, a pin having a diameter within the range of 0.09 inches may be more practical.

The pin twister of the present invention may also be used as a false twist device to impose twist on a yarn going through the second heater of a double-heater false twist machine such as disclosed in U.S. Pat. No. 3,165,881 and which is used for producing set yarns. Controlled imposition of temporary twists in a second heater is made possible by suitably wrapping the yarn around the pin at a location downstream of the heater exit with the pin fixed at a desired angle or subject to rapid variation in this angle with respect to the yarn path, as discussed above. Depending on the mode of yarn wrapping, the resulting false twisting may either increase or decrease the residual torque of the set yarns in a controlled manner.

In the handling of spun (staple) yarns or strands, as well as with continuous filament yarn, the pin twister of the present invention will have utility in minimizing yarn breakage when such staple fiber strands are being transported from one machine location to another in a mill. In such cases, the pin means of the present invention may be advantageously located at various points along the yarn path to provide twist in the yarn which will impart strength due to the temporary twist. Several pin means may be located at a spacing well under the staple length in order to grasp the strands before fiber slippage takes place leading to strand rupture. In the case of zero or low twist continuous filament yarns, the temporary twist will serve to increase lateral bundle cohesion and thus reduce threadline failure due to filament snagging, breakage and strip-back.

With various types of multifilament yarns where the individual filaments, for example, are of a different composition, coloration or fine structure, the pin means of the present invention may be used to cause temporary twist of the filament in order to cause filament migration, that is, filament interchange of position from the inside to the outside of the filament bundle. Once the temporary twist is reversed after passing a pin of the present invention, a portion of the migration pattern is found to remain contributing to bundle cohesion and causing subsequent interesting coloring effects in mixed filament yarns.

While the method of the present invention will be useful with a wide range of presently available yarns, it has been found that the amount of twist that will develop upstream of the pin means will depend on the roundness of the yarn, and its surface roughness and on the diameter and surface smoothness of the pin. In general, the level of the temporary twist will increase with yarn bundle roundness and yarn surface roughness and decrease with increased pin diameter and higher pin surface friction.

Having described the invention, it will be apparent to those skilled in this art that various modifications may be made thereto without departing from the spirit and scope of this invention as defined in the appended claims.

What is claimed is:

1. In a method of producing a stretch yarn of thermoplastic polymer filaments where the yarn is moved along a path from a supply, through a heating zone, a cooling zone and a false twisting zone, the improvement comprising:

applying twist to the moving yarn in the false twisting zone by wrapping the yarn about pin means having a longitudinal axis and which intersects the yarn path at an angle greater than 90° and less than 100° as measured between the longitudinal axis of the pin on the side of the pin adjacent to the area where the yarn leaves the pin means and the path of the yarn downstream of the pin means.

2. The method of claim 1 including the step of feeding the yarn downstream of the false twisting means to fabric forming means and incorporating the false twisted yarn in the fabric formed by said fabric forming means.

3. The method of claims 1 or 2 including the step of imparting vibrating motion to the pin means so that the angle at which the yarn path and pin means intersects is momentarily varied as the yarn passes around the pin means to eliminate contact.

4. The method of claims 1 or 2 including the step of intersecting the yarn path by the pin means at an angle between 90° and 100° such that the yarn leaving the pin means contacts a section of the yarn approaching the pin means whereby a substantial increased amount of twist is imparted to the yarn.

5. The method of claim 4 including the step of varying the angle of intersection to induce variations in the amount of twist imparted to the yarn.

6. The method of claim 5 including the step of varying the angle of intersection momentarily so that the angle of intersection is between 80° and 90° to eliminate temporarily the yarn contact to thereby induce variations in the amount of twist imparted to the yarn.

7. The method as claimed in claim 5 including the step of randomly varying the angle of intersection to introduce random variations in the amount of twist imparted to the moving yarn.

8. The method of producing stretch yarns of thermoplastic polymer filaments wherein a plurality of yarns are substantially simultaneously treated, each yarn being moved along a path from a separate supply, through a heating zone, a cooling zone and a false twisting zone before subsequent wind-up on separate packages, the improvement comprising applying twist to the individual moving yarns in the false twisting zones by wrapping each yarn about a separate pin means each of which intersects the path of its associated yarn at an angle greater than 90° and less than 100° as measured between the axis of each pin means on the side of each pin means adjacent to the area where the yarn leaves each pin means and the path of each yarn downstream of the associated pin means.

9. The method of claim 8 wherein means are provided for varying the angle of intersection that each pin means makes with each individual yarn path and including the step of varying the said angles of intersection to impart variations in the amount of twist imparted to the yarns.

10. The method of claim 8 including the step of varying the angles of intersection substantially uniformly for each pin means and yarn path.

11. The method of claim 9 including the step of varying the angles of intersection so that, for some of the yarns, the angles of intersection are substantially the same and, for the others, the angles of intersection differ.

12. The method of claim 9 including the step of varying each of the angles of intersection in a random manner by vibrating the individual pin means.

13. The method of claims 1 or 2 wherein a plurality of yarns are provided and each is moved from a separate supply through a heating zone, a cooling zone, and a false twisting zone before subsequent wind-up on separate packages, including the step of wrapping at least some of said plurality of yarns about a common pin means so that the angles of intersection of each of said at least some of said plurality of yarns with said common pin means will be substantially equal.

14. The method of claim 1 wherein said pin means is flexible along said longitudinal axis and including the step of applying a varying element of twist to the moving yarn by flexing said pin means to vary said angle of intersection within the range of 90° to 100°.

15. In a method of handling a yarn strand while the strand is moving from one location to another location, comprising the step of imposing twist on the yarn by wrapping the yarn strand 360° about a cylindrical pin means having a longitudinal axis and which intersects the yarn path at an angle greater than 90° and less than 100° as measured between the axis of the pin on the side of the pin adjacent the area where the yarn leaves the pin means and the path of the yarn downstream of the pin means.

16. The method as claimed in claim 14 including the step of varying the angle of intersection of the pin means with the yarn path.

17. The method as claimed in claim 15 including the step of momentarily varying the angle of intersection so that the angle of intersection is less than 90° to eliminate yarn contact on the pin means to thereby induce variations in the amount of twist imparted to the yarn.

18. In a method of producing a stretch yarn of thermo-plastic polymer filaments where the yarn is moved along a path from a supply, through a heating zone, a cooling zone and a false twisting zone, the improvement comprising:

applying twist to the moving yarn in the false twisting zone by wrapping the yarn about pin means having a longitudinal axis and which intersects the yarn path at an angle greater than 90° and less than 100° as measured between the longitudinal axis of the pin and the path of the yarn downstream of the pin means, imparting vibrating motion to the pin means so that the angle at which the yarn path and pin means intersects is momentarily varied as the yarn passes around the pin means to eliminate contact.

19. The method as claimed in claim 18 including the step of feeding the yarn downstream of the false twisting means to fabric forming means and incorporating the false twisted yarn in the fabric formed by said fabric forming means.

20. The method of producing stretch yarns of thermo-plastic polymer filaments wherein a plurality of yarns are substantially simultaneously treated, each yarn being moved along a path from a separate supply, through a heating zone, a cooling zone and a false twisting zone before subsequent wind-up on separate packages, the improvement comprising applying twist to the individual moving yarns in the false twisting zones by wrapping each yarn about a separate pin means each of which intersects the path of its associated yarn at an angle greater than 90° and less than a 100° as measured between the axis of each pin means and the path of each yarn downstream of the associated pin means, and varying the angle of intersection that each pin means makes with each individual yarn path and varying the said angles of intersection in a random manner to impart variations in the amount of twist imparted to the yarns.

21. In a method of producing a stretch yarn of thermo-plastic polymer filaments where the yarn is moved along a path from a supply, through a heating zone, a cooling zone and a false twisting zone, the improvement comprising:

applying twist to the moving yarn in the false twisting zone by wrapping the yarn about pin means having a longitudinal axis and which intersects the yarn path at an angle greater than 90° and less than 100° as measured between the longitudinal axis of the pin means and the path of the yarn downstream of the pin means, said pin means being flexible along said longitudinal axis and applying a varying element of twist to the moving yarn by flexing said pin means to vary said angle of intersection within the range of 90° to 100°.

22. In a method of handling a yarn strand while the strand is moving from one location to another location, comprising the step of imposing twist on the yarn by wrapping the yarn strand 360° about a pin means having a longitudinal axis and which intersects the yarn path at an angle greater than 90° and less than 100° as measured between the axis of the pin means on the side of the pin means adjacent the area where the yarn leaves the pin means and the path of the yarn downstream of the pin means, momentarily varying the angle of intersection so that the angle of intersection is less than 90° to eliminate yarn contact on the pin means to thereby induce variations in the amount of twist imparted to the yarn.

23. In a method of producing set textured double heater yarn of thermo-plastic polymer filaments where the yarn is moved along a path exiting a first heater, false twisting zone and passing through a second heater zone, the improvement comprising applying torque to the moving yarn in the second heater by wrapping the yarn around pin means having a longitudinal axis and which intersects the the yarn path at an angle greater than 90° and less than 100° as measured between the longitudinal axis of the pin means on the side of the pin means adjacent to the area where the yarn leaves the pin means and the path of the yarn downstream of the pin means.

24. The method claimed in claim 23, including the step of momentarily varying the angle of intersection so that the angle of intersection is less than 90° to eliminate yarn contact on the pin means to thereby induce variations in the amount of torque applied to the yarn in the second heater and thus to alter the residual torque along its length.

* * * * *